US008554111B2

(12) United States Patent
Kondo

(10) Patent No.: US 8,554,111 B2
(45) Date of Patent: Oct. 8, 2013

(54) IMAGE FORMING APPARATUS

(75) Inventor: Hakudai Kondo, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 384 days.

(21) Appl. No.: 12/892,653

(22) Filed: Sep. 28, 2010

(65) Prior Publication Data

US 2011/0129276 A1 Jun. 2, 2011

(30) Foreign Application Priority Data

Nov. 27, 2009 (JP) ..... 2009-269983

(51) Int. Cl.
*G03G 21/16* (2006.01)

(52) U.S. Cl.
USPC ..... 399/124; 399/262; 399/121; 399/258; 271/10.11; 271/306

(58) Field of Classification Search
USPC ..... 399/262, 121, 258; 271/10.11, 306
See application file for complete search history.

(56) References Cited

U.S. PATENT DOCUMENTS

| | | | | |
|---|---|---|---|---|
| 2007/0160382 | A1 | 7/2007 | Tomatsu | |
| 2008/0003015 | A1* | 1/2008 | Tomatsu | 399/110 |
| 2009/0051101 | A1* | 2/2009 | Yamagishi | 271/171 |

FOREIGN PATENT DOCUMENTS

| | | | |
|---|---|---|---|
| JP | S60-059264 | U | 4/1985 |
| JP | H07-206182 | A | 8/1995 |
| JP | 2000-247458 | A | 9/2000 |
| JP | 2001-166550 | A | 6/2001 |
| JP | 2005-289571 | A | 10/2005 |
| JP | 2006-184901 | A | 7/2006 |
| JP | 2007-148142 | A | 6/2007 |
| JP | 2007-218987 | A | 8/2007 |

OTHER PUBLICATIONS

Japan Patent Office, Decision of Patent Grant for Japanese Patent Application No. 2009-269983 (counterpart to above-captioned patent application), dispatched Oct. 18, 2011.

* cited by examiner

*Primary Examiner* — Walter L Lindsay, Jr.
*Assistant Examiner* — Roy Y Yi
(74) *Attorney, Agent, or Firm* — Baker Botts L.L.P.

(57) ABSTRACT

An image forming apparatus includes: a recording medium cassette storing recording medium; an image forming unit, a feed unit; an upper frame that supports the image forming unit and the feed unit; and a lower frame in which the recording medium cassette is detachably attached, the upper frame being disposed on the lower frame, and the lower frame having rigidity lower than the rigidity of the upper frame, the lower frame including a rail for guiding the recording medium cassette to a predetermined receiving position, wherein the feed unit has a groove portion formed along a direction parallel to a horizontal direction, the recording medium cassette has a first convex portion which is fitted in the groove portion when the recording medium cassette is attached in the lower frame, the recording medium cassette having a second convex portion which is contact with a portion of the rail of the lower frame.

7 Claims, 8 Drawing Sheets

IMAGE FORMING APPARATUS

CROSS REFERENCE TO RELATED APPLICATION

The present application claims priority from Japanese Patent Application No. 2009-269983, which was filed on Nov. 27, 2009, the disclosure of which is herein incorporated by reference in its entirety.

TECHNICAL FIELD

Apparatuses and devices consistent with the present invention relate to an image forming apparatus.

BACKGROUND

Hitherto, there has been a related art tandem type image forming apparatus having structure where a plurality of image forming unit for forming images having different colors (for example, yellow, magenta, cyan, and black) are arranged in series along a conveying path of a recording medium. In this related art, a frame structure where an upper frame is mounted on a lower frame, and the rigidity of the lower frame is lower than the rigidity of the upper frame.

If the frame structure of the related art is employed, the lower frame having low rigidity may be twisted or distorted as a biased load is applied to the frame structure of the image forming apparatus due to the difference in level and the inclination at a position where the apparatus is disposed. Therefore, even though the rigidity of the entire of the frame structure is not increased, it may be possible to suppress the generation of the twisting or distortion at the upper frame having high rigidity and to maintain high accuracy in the relative positional relationship between a plurality of image forming unit assembled with the upper frame. Further, since the rigidity of the entire frame structure does not need to be increased, it may be possible to suppress the increase in the weight of the entire frame structure.

Further, in the image forming apparatus of the related art, a recording medium cassette for storing recording media or feed unit for feeding a recording medium to the image forming unit (four sets of image forming units) are mounted on the lower frame. In order to supply recording media to the recording medium cassette, the recording medium cassette is generally formed so as to be drawn or separated from an apparatus body. As a specific example of this structure, there is a structure where a recording medium cassette slides along a guide mechanism.

SUMMARY

However, if the lower frame is deformed due to the difference in level and the inclination at a position where the apparatus is disposed when the feed unit is mounted on the lower frame, the feed unit is also displaced so as to follow the deformation of the lower frame.

Therefore, a relative positional relationship between the feed unit and the upper frame is significantly changed in an up-down direction. In this case, a conveying path, which reaches the image forming unit from the feed unit, is deviated from a position, which has been optimized before the deformation, to some extent.

Further, if the above-mentioned lower frame is provided with the guide mechanism, the recording medium cassette disposed in the lower frame is supported from below over the entire range between one end and the other ends of the guide mechanism in a longitudinal direction.

Therefore, even though the guide mechanism is deformed along with the deformation of the lower frame at any position in the range between one end and the other ends of the guide mechanism in a longitudinal direction, the recording medium cassette is displaced so as to follow the deformation of the guide mechanism. In this case, the relative positional relationship between the recording medium cassette and the feed unit is changed.

That is, there is a concern that both a relative position between the feed unit and the image forming unit and a relative position between the recording medium cassette and the feed unit will be changed along with the deformation of the lower frame. As a result, there is a concern that the accuracy at which a recording medium is fed by the feed unit, such as the accuracy at which a recording medium is picked up from the recording medium cassette by the feed unit as well as the accuracy at which a recording medium is conveyed to the image forming unit from the feed unit, will deteriorate.

The invention has been made to solve the above-mentioned problem, and an object of the invention is to provide an image forming apparatus capable of preventing or suppressing the deterioration of the accuracy of a recording medium, which is fed by feed unit, before and after the deformation of a lower frame.

According to an illustrative aspect of the present invention, there is a provided an image forming apparatus comprising: a recording medium cassette that stores a recording medium; an image forming unit that forms images on the recording medium; a feed unit that feeds the recording medium stored in the recording medium cassette to the image forming unit; a pair of upper frames that is disposed with a distance between the upper frames in a left-right direction, and supports the image forming unit and the feed unit, which are disposed between the upper frames, from both left and right sides; and a pair of lower frames that is disposed with a distance between the lower frames in the left-right direction, the recording medium cassette being detachably attached in a space formed between the lower frames, the upper frames being disposed on the lower frames, respectively, and the lower frames having rigidity lower than the rigidity of the upper frames, wherein assuming that one end of both ends of the recording medium cassette in a front-rear direction, which is disposed close to the feed unit when the recording medium cassette is attached between the pair of lower frames, is referred to as a first end and the other end thereof, which is disposed distant from the feed unit when the recording medium cassette is attached between the pair of lower frames, is referred to as a second end, when the recording medium cassette is attached between the pair of lower frames, a first contact portion, which is positioned at the first end, comes into contact with a first portion, of which a relative position relative to the upper frame in the up-down direction is not changed, at the first end, so that the recording medium cassette is positioned in the up-down direction, and a second contact portion, which is positioned at the second end, comes into contact with a second portion, of which a relative position relative to the lower frame in the up-down direction is not changed, at the second end, so that the recording medium cassette is positioned in the up-down direction.

According to another illustrative aspect of the present invention, there is a provided an image forming apparatus comprising: a recording medium cassette that stores recording medium; an image forming unit that forms images on the recording medium; a feed unit that feeds the recording medium stored in the recording medium cassette to the image forming unit; an upper frame that supports the image forming unit and the feed unit; and a lower frame in which the recording medium cassette is detachably attached, the upper frame being disposed on the lower frame, and the lower frame having rigidity lower than the rigidity of the upper frame, the lower frame including a rail for guiding the recording medium cassette to a predetermined receiving position when the recording medium cassette is attached in the lower frame, wherein the feed unit, which is supported by the upper frame, has a groove portion that is formed along a direction parallel to a horizontal direction, the recording medium cassette has a first convex portion which is fitted in the groove portion when the recording medium cassette is attached in the lower frame, the recording medium cassette having a second convex portion which is contact with a portion of the rail of the lower frame.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

An embodiment of the invention will be described below using an example.

[Structure of Image Forming Apparatus]

Figure 1:
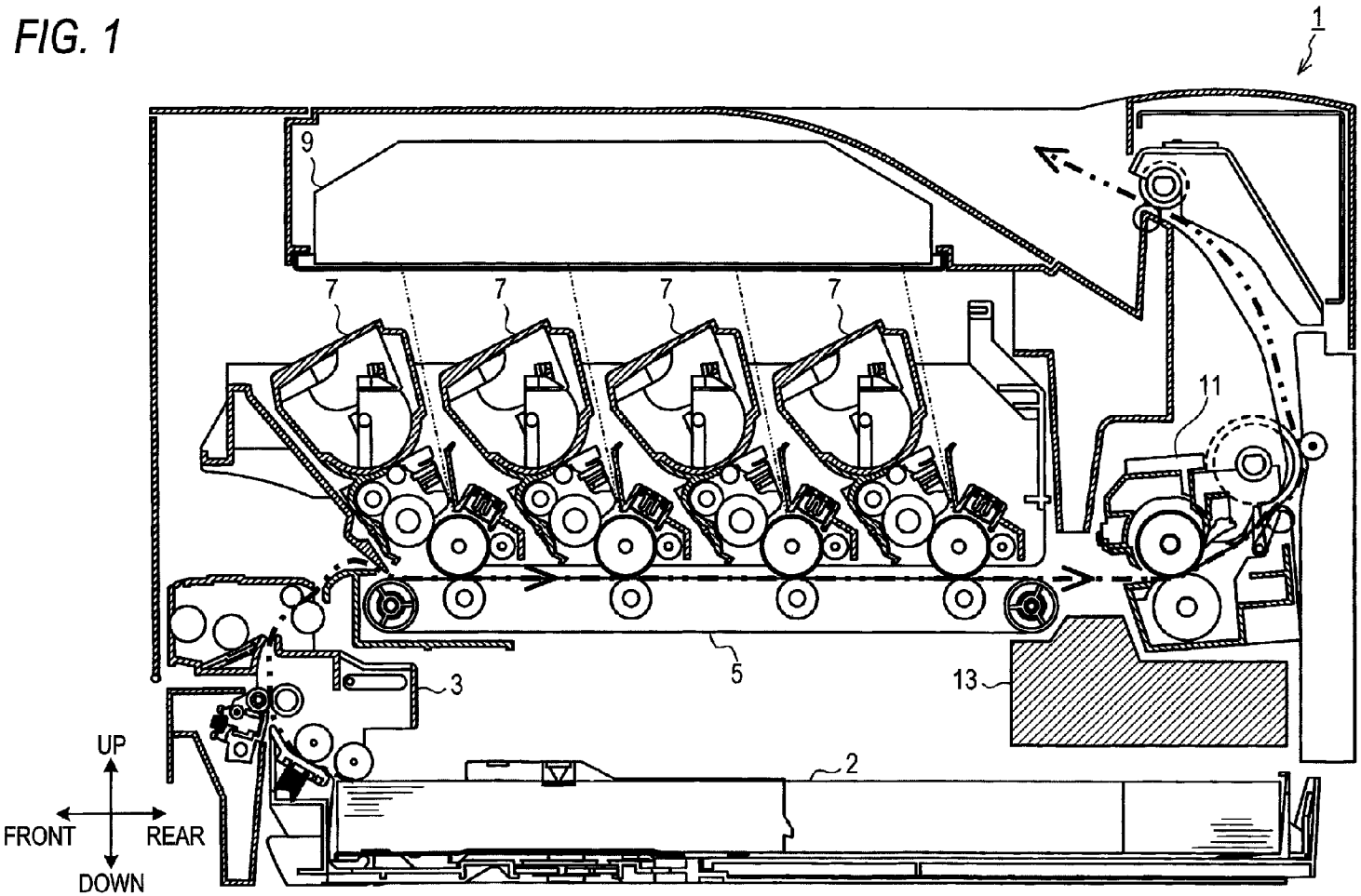
FIG. 1 is a longitudinal sectional view of an image forming apparatus when seen from the right side.

An image forming apparatus 1 shown in FIG. 1 is a tandem type image forming apparatus that forms an image by an electrophotographic system. In this embodiment, the structure of the image forming apparatus 1 will be described below using an up-down direction, a left-right direction, and a front-rear direction that are shown in drawings. The respective directions are defined as follows: a direction where a vertical line extends when the image forming apparatus 1 is installed on a horizontal plane is defined as the up-down direction, a direction parallel to a conveying direction of a recording medium on which images are being formed is defined as the front-rear direction, and a direction perpendicular to the up-down direction and the front-rear direction is defined as the left-right direction. However, these respective directions are defined to describe a relative positional relationship between respective portions of the image forming apparatus 1, and do not mean that the image forming apparatus 1 should be installed in a specific direction.

The image forming apparatus 1 includes a recording medium cassette 2, a feed unit 3, a belt unit 5, process cartridges 7, a scanner unit 9, a fixing device 11, and the like.

Among them, the recording medium cassette 2 is a part that stores recording media, and may be drawn toward the front side and separated.

The feed unit 3 is provided to feed the recording media, which are stored in the recording medium cassette 2, to the downstream side on a conveying path (a path shown by a two-dot chain line in FIG. 1). The recording media stored in the recording medium cassette 2 are drawn from the recording medium cassette 2 by the feed unit 3 and fed to the downstream side on the conveying path.

The belt unit 5 is a unit for conveying a recording medium, which is fed from the feed unit 3, to the rear side from the front side while the recording medium is interposed between the process cartridges 7 and the belt unit.

Four sets of process cartridges 7 are arranged in series above the belt unit 5 at regular intervals. Each of the process cartridges 7 includes a photoreceptor and a developing mechanism that develops an electrostatic latent image formed on the photoreceptor.

The scanner unit 9 is a unit that forms electrostatic latent images on the photoreceptors by irradiating the photoreceptors of the respective process cartridges 7 with laser light. The electrostatic latent images formed on the photoreceptors by the scanner unit 9 are developed by the developing mechanisms of the process cartridges 7, so that the electrostatic latent images become toner images. The toner images are transferred to the recording medium that is conveyed on the belt unit 5.

The fixing device 11 is a device for fixing the toner images to the recording medium by heating and pressing the recording medium, on which the toner images have been transferred, while the recording medium is interposed between rollers. The recording medium, which has passed through the fixing device 11, is further conveyed by some more rollers and is discharged onto an upper surface of the image forming apparatus 1.

Meanwhile, a low-voltage power supply unit 13 is provided at a position that is below the fixing device 11 and above the recording medium cassette 2.

[Structure of Frame of Image Forming Apparatus]

Figure 2:
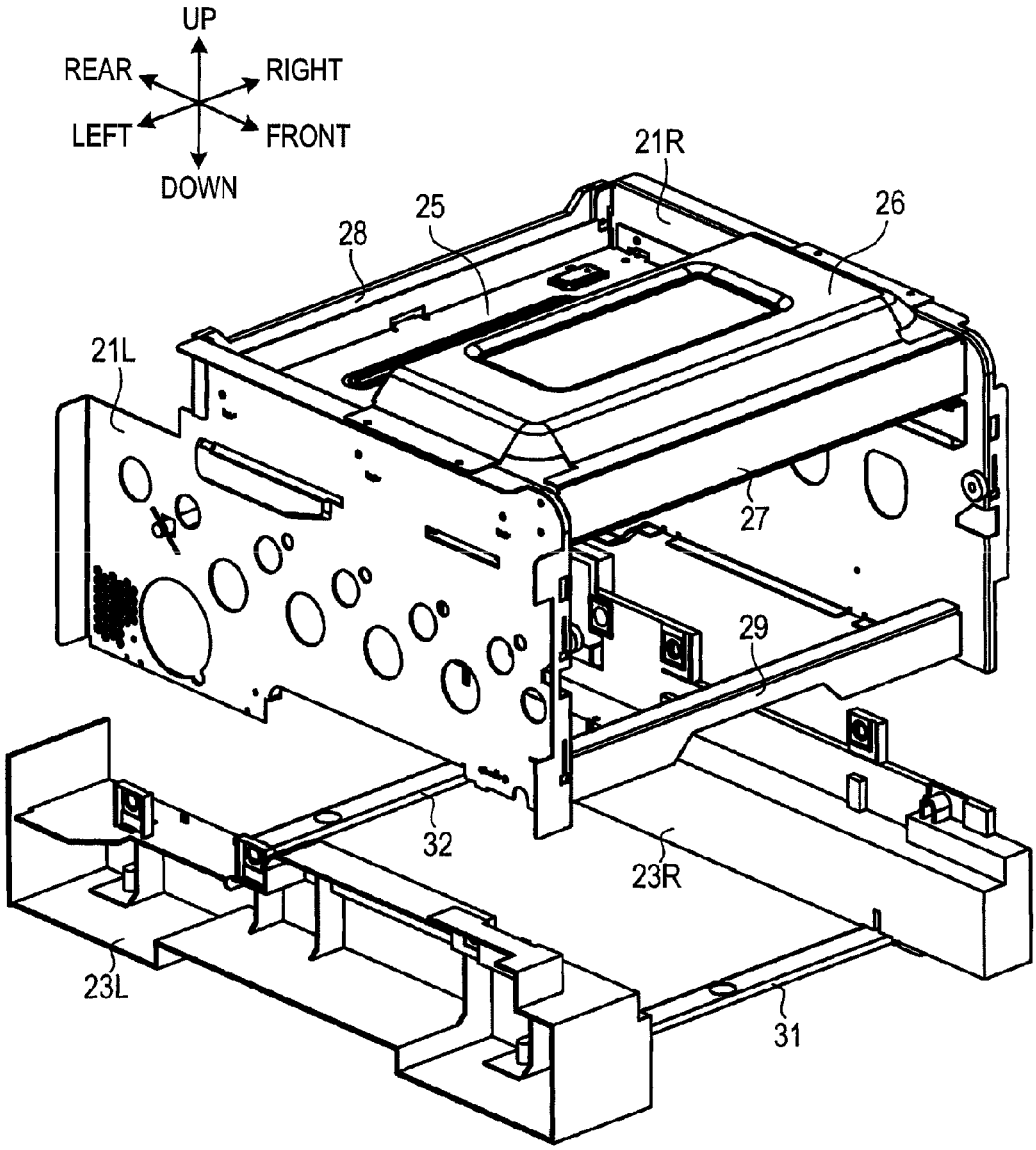
FIG. 2 is a perspective view of upper and lower frames.

The structure of a frame of the image forming apparatus 1 will be described below. The image forming apparatus 1 includes upper frames 21L and 21R and lower frames 23L and 23R as members, which become a framework for supporting the above-mentioned various members, shown in FIG. 2.

Among them, the upper frames 21L and 21R are members made of sheet metal, and mounted on and fixed to the lower frames 23L and 23R. In detail, the upper frames are erected on the lower frames 23L and 23R with a distance between the lower frames in the left-right direction so that punching directions correspond to the left-right direction.

Further, sheet metal members, such as a scanner plate 25, a scanner cover 26, a front beam 27, a rear beam 28, and an under beam 29, are provided between the upper frames 21L and 21R.

Meanwhile, the lower frames 23L and 23R have rigidity lower than the rigidity of the upper frames 21L and 21R, and allow deformation to some extent.

Specifically, in the case of this embodiment, the lower frames 23L and 23R are formed of resin members, which have rigidity lower than the rigidity of the upper frames 21L and 21R made of sheet metal. A front beam 31, a rear beam 32, and the like are provided between these lower frames 23L and 23R.

In the above-mentioned frame structure, the feed unit 3, the belt unit 5, the process cartridge 7, the scanner unit 9, the fixing device 11, and the like are disposed between the upper frames 21L and 21R. Further, these are supported by the upper frames 21L and 21R from both left and right sides.

Accordingly, the loads of the structures, which are disposed on the upper frames 21L and 21R, are transmitted to the lower frames 23L and 23R through the upper frames 21L and 21R, and the lower frames 23L and 23R support the loads generated at the upper frames 21L and 21R.

Furthermore, the recording medium cassette 2 is attached between the lower frames 23L and 23R. Although described in detail below, the front end of the recording medium cassette 2 is supported by the structures of the upper frames 21L and 21R, and the rear end thereof is supported by the structures of the lower frames 23L and 23R.

[Support Structure and Positioning Structure of Recording Medium Cassette]

The support structure and the positioning structure of the recording medium cassette 2 will be described below.

Figure 3:
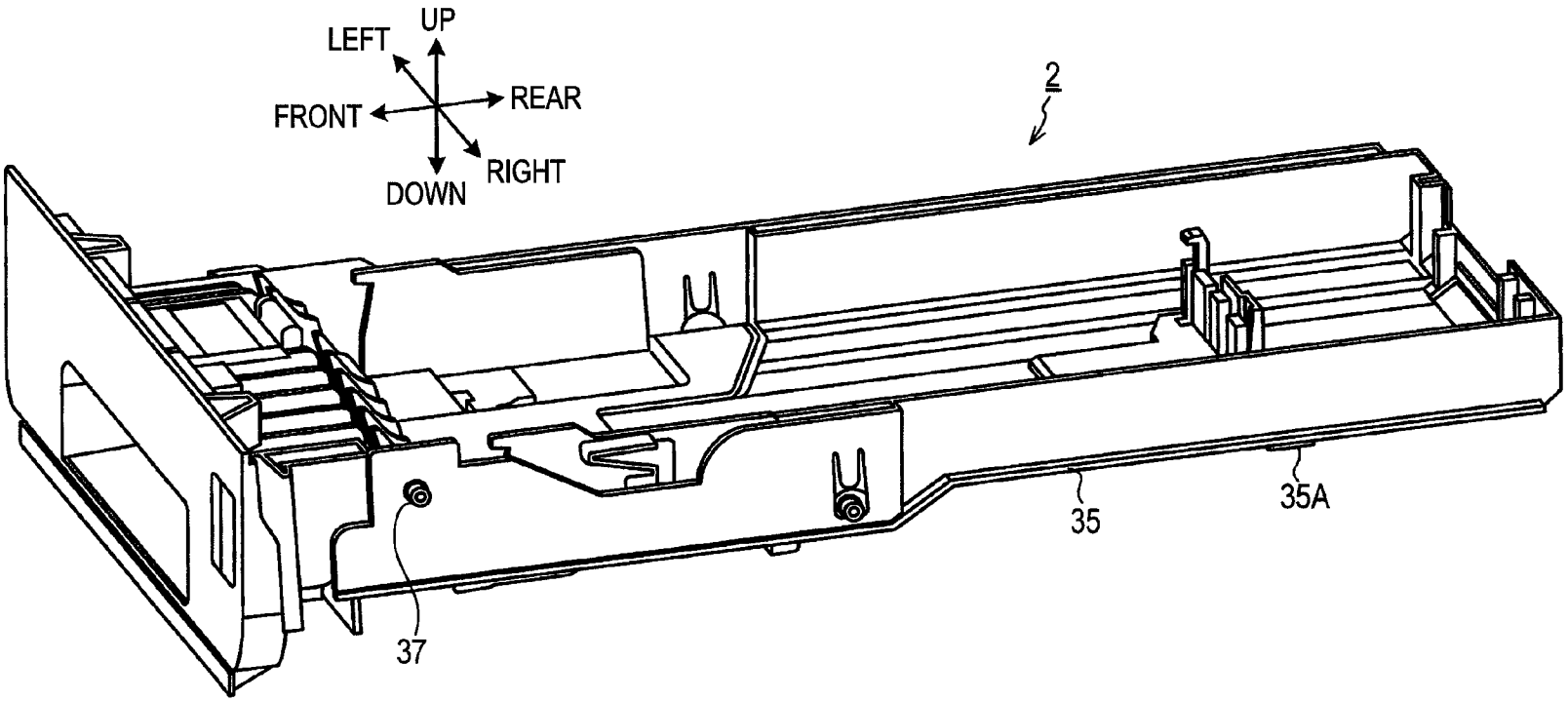
FIG. 3 is a perspective view of a recording medium cassette.

As shown in FIG. 3, the recording medium cassette 2 is formed in the shape of a drawer as a whole, and the upper side of the recording medium cassette is opened so that recording media may be received in the recording medium cassette. Protruding pieces 35, which protrude toward both sides and continuously extend in the front-rear direction, are formed at positions near the lower end on both the left and right side surfaces of the recording medium cassette 2.

Further, positioning bosses 37 protrude from both the left and right side surfaces of the recording medium cassette 2 at positions near the front end of the recording medium cassette. The protruding pieces 35 and the positioning bosses 37 are formed so as to be symmetrical in the image forming apparatus 1. Accordingly, only the positioning boss formed on the right side surface of the recording medium cassette 2 is shown in FIG. 3, but the same positioning boss is formed on the left side surface of the recording medium cassette 2 at the same position.

Figure 4:
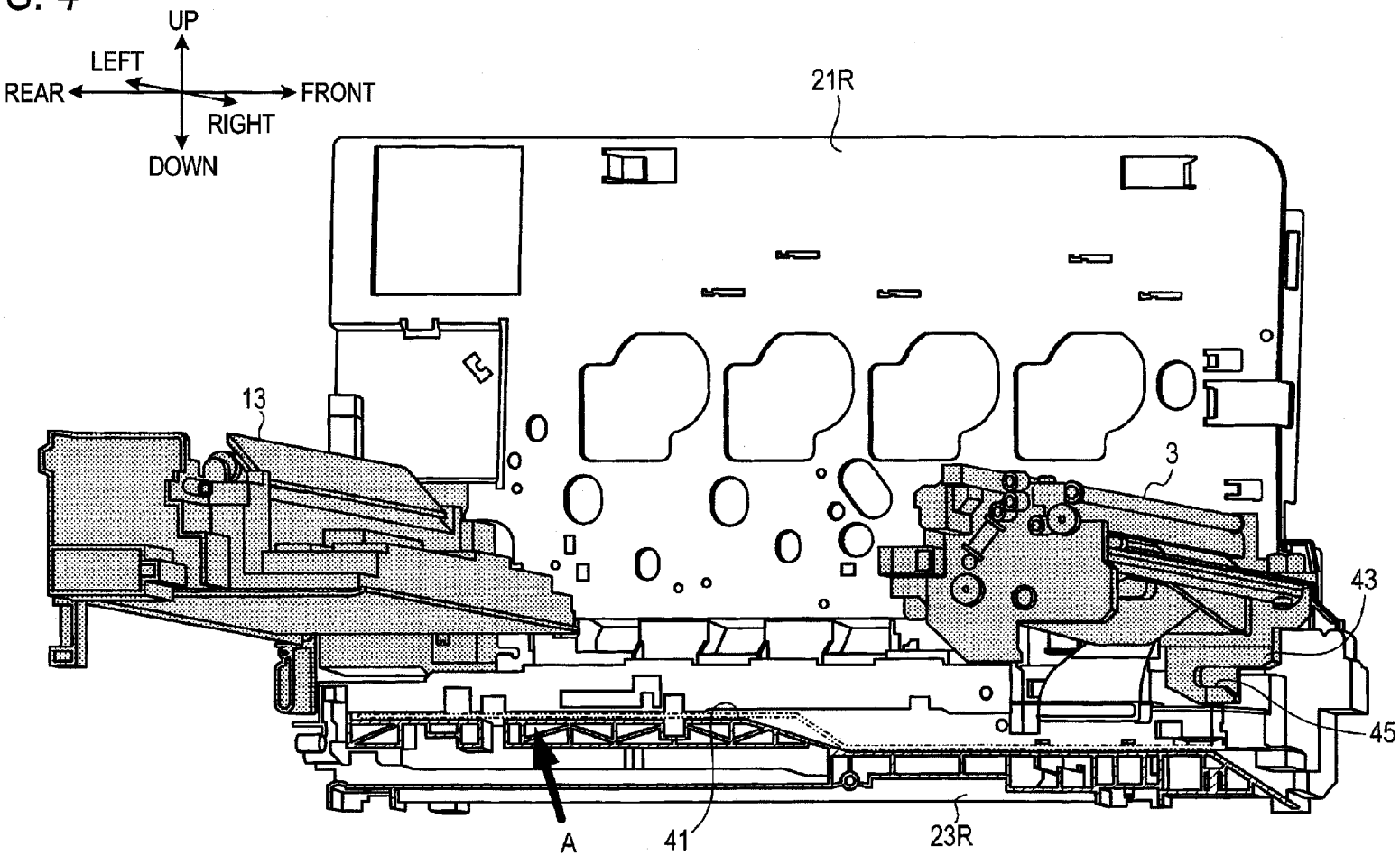
FIG. 4 is a perspective view showing a right upper frame, a right lower frame, a feed device, and a low-voltage power supply unit.

Meanwhile, as shown in FIG. 4, guide rails 41 are formed on the lower frames 23L and 23R. Further, the feed unit 3, the low-voltage power supply unit 13, and the like are provided between the upper frames 21L and 21R as already described above (see shaded portions in FIG. 4), and positioning grooves 45 are formed at a feed frame 43 of the feed unit 3.

The guide rails 41 and the positioning grooves 45 are formed so as to also be symmetrical in the image forming apparatus 1. Only components provided on the inner side of the lower frame 23R (the left side of the lower frame 23R), which is positioned on the right side of the image forming apparatus 1, are shown in FIG. 4. However, the same components are also provided at the same positions on the inner side of the lower frame 23L (the right side of the lower frame 23L) that is positioned on the left side of the image forming apparatus 1.

In the above-mentioned structure, the guide rails 41 function to guide the protruding pieces 35 when the recording medium cassette 2 is attached between the lower frames 23L and 23R. That is, when the recording medium cassette 2 is attached between the lower frames 23L and 23R, the protruding pieces 35 are displaced along the guide rails 41, so that it may be possible to smoothly push the recording medium cassette 2 into a space that is formed between the lower frames 23L and 23R.

Figure 5:
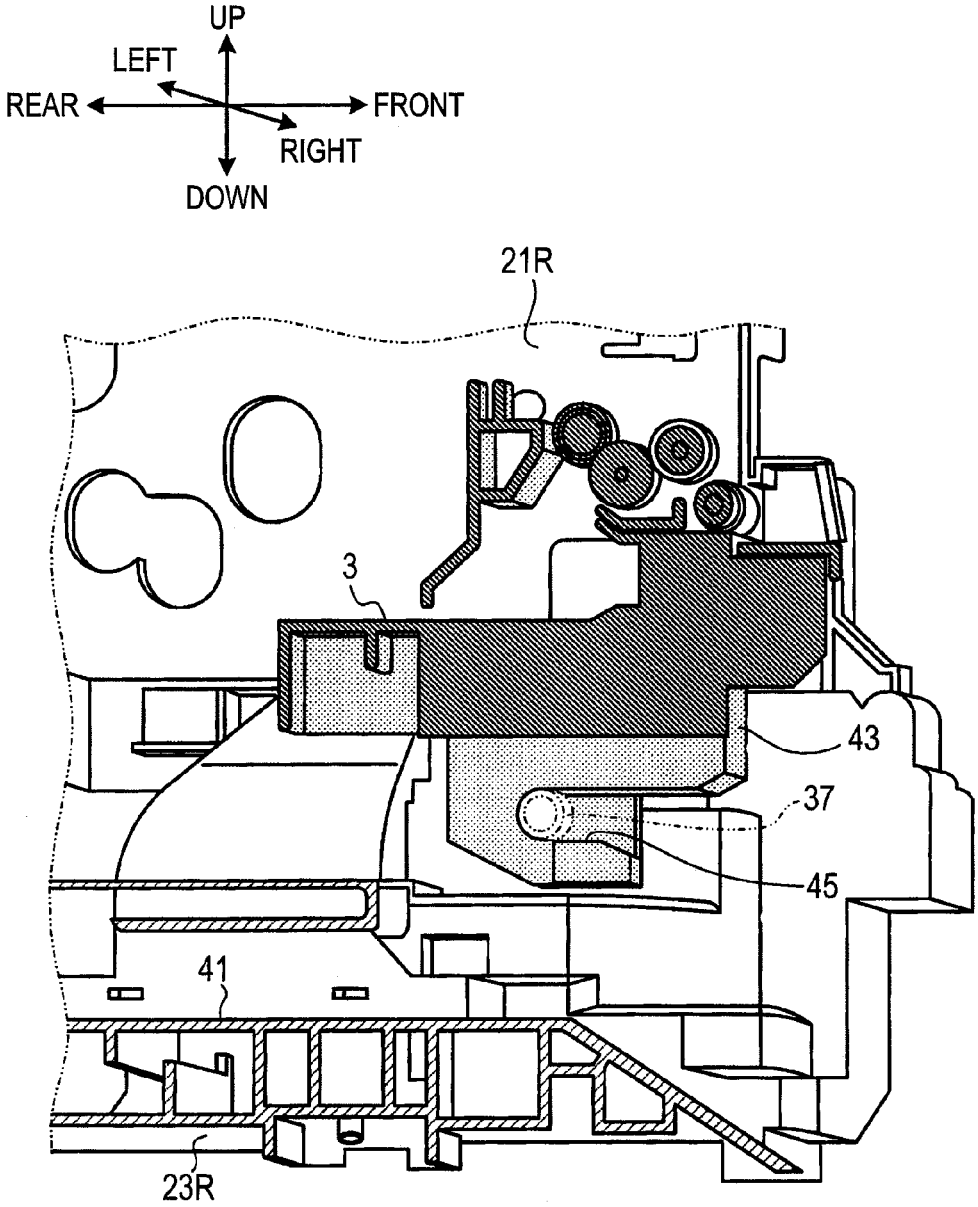
FIG. 5 is a perspective view showing peripheral portions of a positioning boss and a positioning groove.

Further, when the recording medium cassette 2 is pushed to a predetermined receiving position (a position where the protruding piece 35 reaches a portion shown by a two-dot chain line in FIG. 4), the positioning boss 37 is fitted to the positioning groove 45 as shown in FIG. 5 (in FIG. 5, other portions of the recording medium cassette 2 are not shown and only the positioning boss 37 is shown by a two-dot chain line in order to clarify the position of the positioning boss 37.).

The positioning bosses 37 are fitted to the positioning grooves 45, so that the front end of the recording medium cassette 2 is positioned relative to the positioning groove 45 in the up-down direction and the front-rear direction. As a result, the front end of the recording medium cassette 2 is also positioned relative to the upper frames 21L and 21R and the feed unit 3 in the up-down direction and the front-rear direction.

Figure 6A:
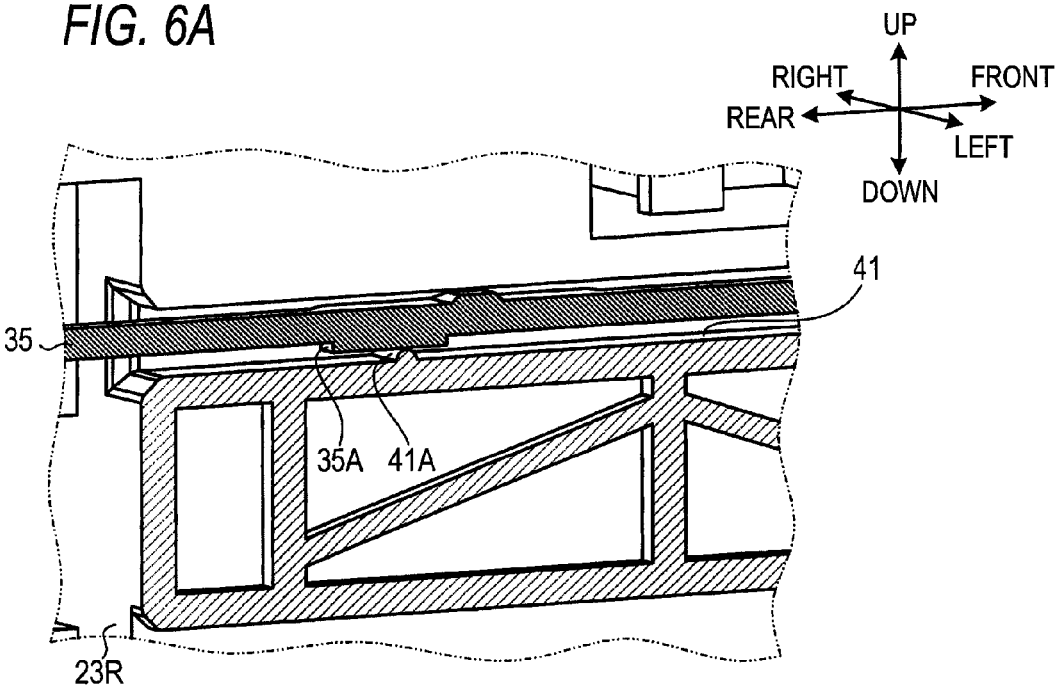
FIG. 6A is a perspective view of a convex portion of a protruding piece and a convex portion of a guide rail.

Furthermore, when the recording medium cassette 2 is pushed to the above-mentioned receiving position, a convex portion 35A of the protruding piece 35 and a convex portion 41A of the guide rail 41 come into contact with each other at a portion A shown in FIG. 4 as enlarged in FIG. 6A.

Figure 6B:
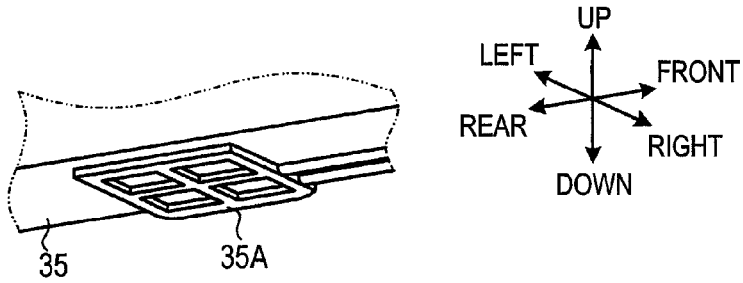
FIG. 6B is perspective view of the convex portion of the protruding piece.
Figure 6C:
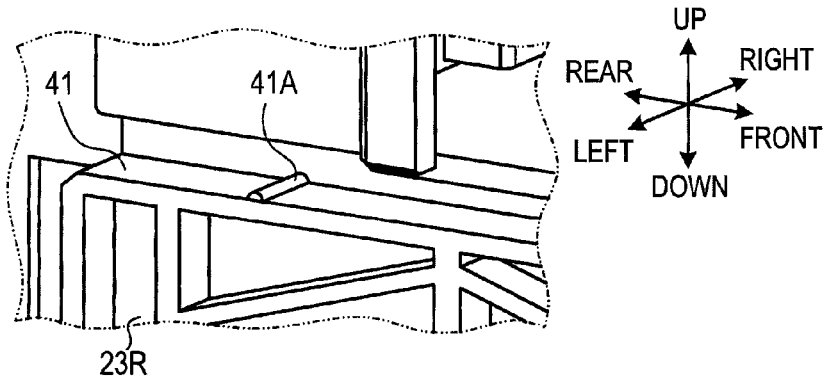
FIG. 6C is a perspective view of the convex portion of the guide rail.

As shown in FIG. 6B, the convex portion 35A of the protruding piece 35 protrudes downward from the lower surface of the protruding piece 35, and recesses are partially formed within a protruding portion. Meanwhile, as shown in FIG. 6C, the convex portion 41A of the guide rail 41 protrudes upward from the upper surface of the guide rail 41.

The convex portion 35A and the convex portion 41A come into contact with each other, so that the rear end of the recording medium cassette 2 is positioned relative to the guide rail 41 in the up-down direction. As a result, at the contact portion between the convex portion 35A and the convex portion 41A, the rear end of the recording medium cassette 2 is positioned relative to the lower frames 23L and 23R in the up-down direction.

Meanwhile, the convex portions 41A are formed at a plurality of positions, which are separated from each other in the front-rear direction, on the upper surface of the guide rail 41. For this reason, small gaps are formed at front and rear positions of the plurality of convex portions 41A, so that friction between the protruding piece 35 and the guide rail 41 is reduced.

Figure 7A:
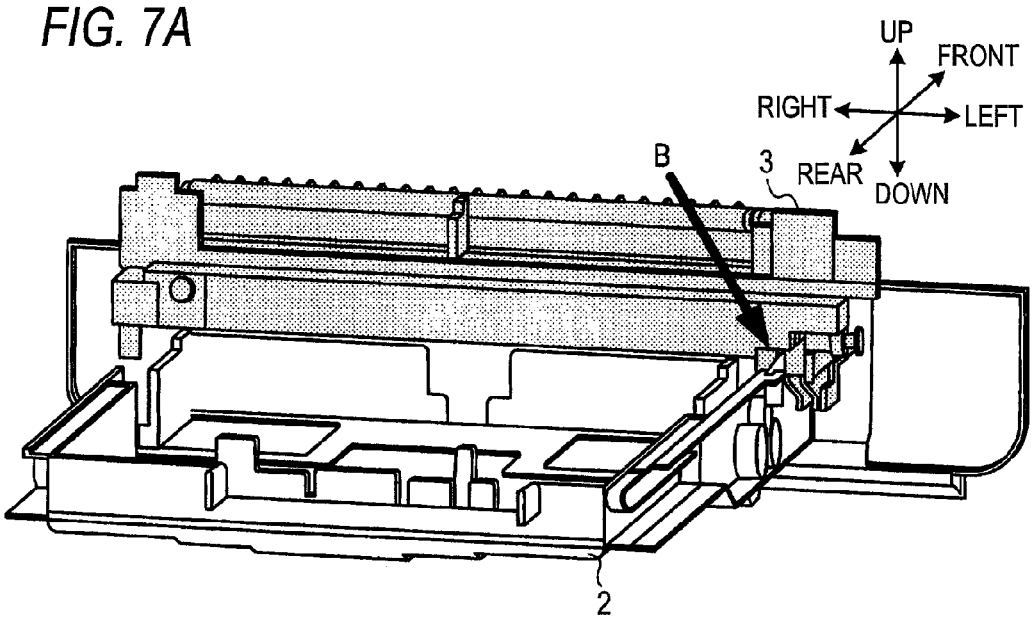
FIG. 7A is a perspective view of the recording medium cassette and the feed device and FIG. 7B is a view showing a rib of the recording medium cassette and a groove of a feed frame.
Figure 7B:
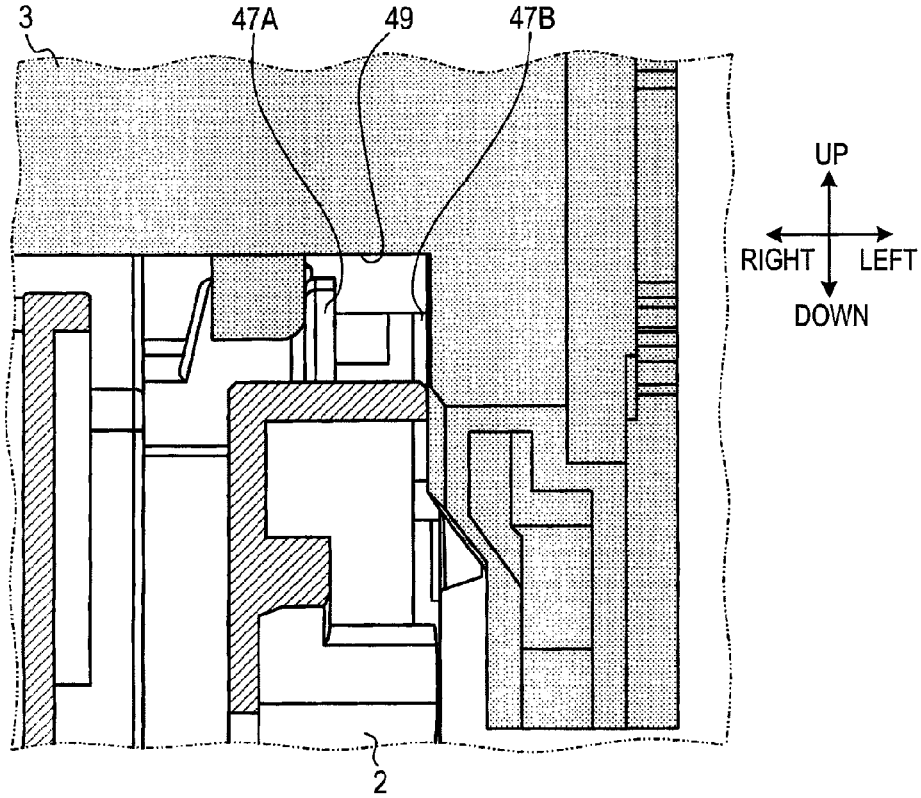

In addition, when the recording medium cassette 2 is pushed to the above-mentioned receiving position, a pair of ribs 47A and 48B protruding from the recording medium cassette 2 is fitted to a groove 49 of the feed frame 43 at a portion B shown in FIG. 7A as enlarged in FIG. 7B, so that the recording medium cassette 2 and the feed frame 43 of the feed unit 3 are positioned relative to each other in the left-right direction.

[Deformation of Lower Frame and Displacement of Respective Portions]

How the respective portions of the image forming apparatus 1 are deformed when the lower frames 23L and 23R are deformed will be described below with reference to FIG. 8.

Pairs of leg portions 51 and 52, which protrude downward, are formed at the lower ends of the respective lower frames 23L and 23R of the image forming apparatus 1 at positions P1 and P2 that are apart from each other in the front-rear direction.

Further, load transmission portions 53 and 54, where loads are transmitted to the lower frames 23L and 23R from the upper frames 21L and 21R, are formed at the lower ends of the respective upper frames 21L and 21R at positions P3 and P4 that are apart from each other in the front-rear direction.

The positions P3 and P4 of the load transmission portions 53 and 54 may be set to arbitrary positions by changing the shapes of the lower ends of the upper frames 21L and 21R and the upper ends of the lower frames 23L and 23R or the positions of the connection portions. In the case of this embodiment, the positions P3 and P4 of the load transmission portions 53 and 54 are set to positions between the positions P1 and P2 of the leg portions 51 and 52 in the front-rear direction.

Figure 8B:
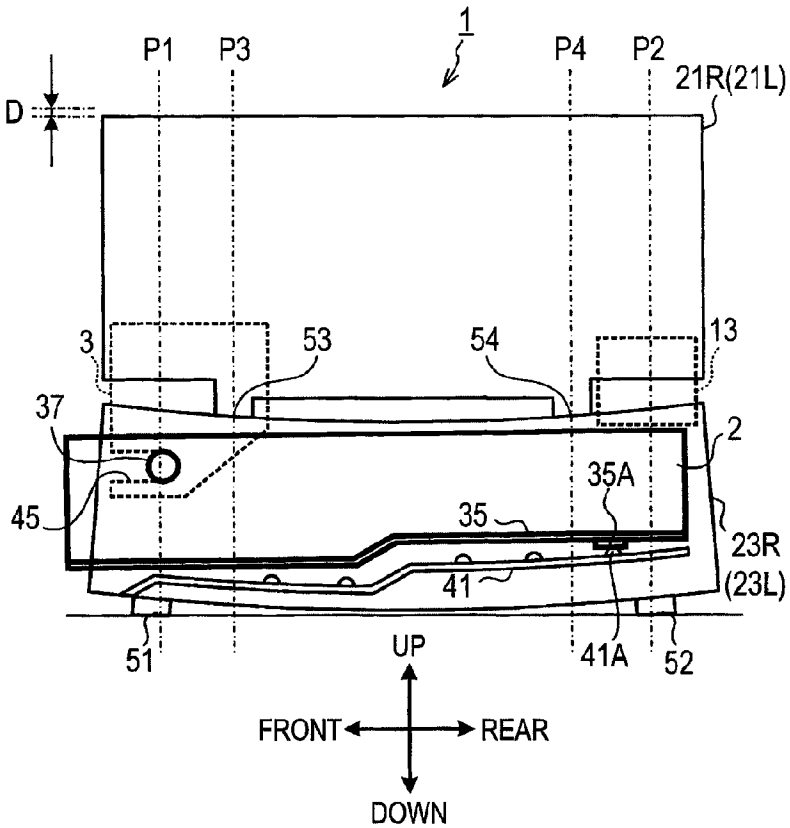
FIG. 8A and FIG. 8B are views illustrating the displacement of the respective portions when the lower frames are deformed.
Figure 8A:
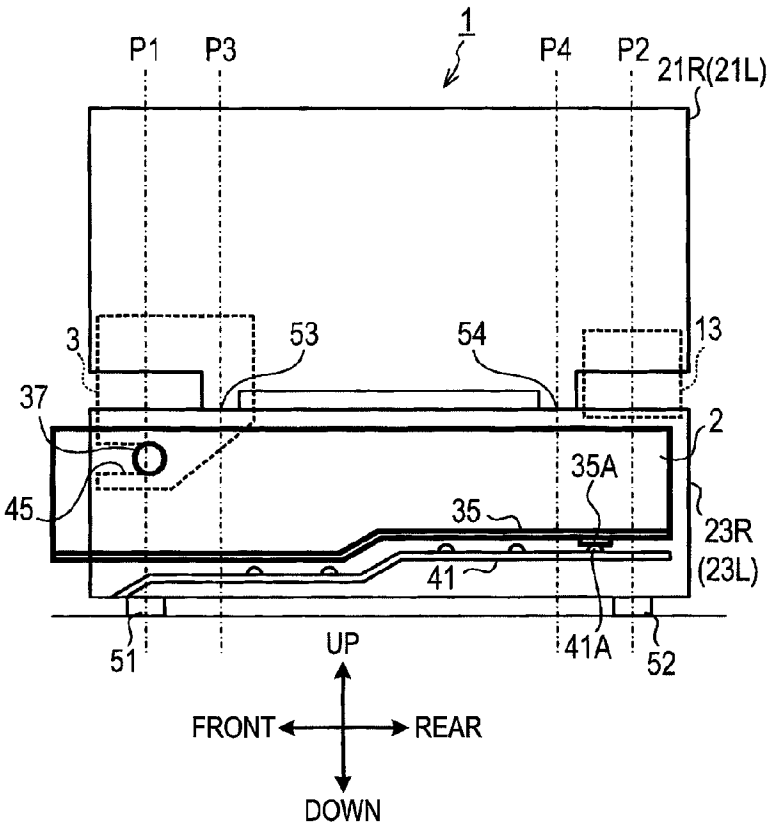

Therefore, the lower frames 23L and 23R having low rigidity are apt to be deformed from the design shape shown in FIG. 8A to the shape where the middle portion in the front-rear direction is slightly saggy as shown in FIG. 8B, due to the loads applied to the load transmission portions 53 and 54. That is, the lower frames 23L and 23R are designed to allow the above-mentioned deformation. Accordingly, the lower frames absorb the difference in level and the inclination at the installation site.

If the lower frames 23L and 23R are deformed from the shape shown in FIG. 8A to the shape shown in FIG. 8B, the upper frames 21L and 21R are moved downward by a distance D shown in FIG. 8B.

Further, when the upper frames 21L and 21R are moved downward as described above, the feed unit 3, the belt unit 5, the process cartridge 7, and the like, which are supported by the upper frames 21L and 21R, are also moved downward by the distance D.

In contrast, the displacement of the front end of the recording medium cassette 2 is different from that of the rear end of the recording medium cassette. Specifically, the positioning bosses 37 are fitted into the positioning grooves 45 of the feed frame 43 at the front end of the recording medium cassette 2, so that the front end of the recording medium cassette 2 is positioned relative to the feed unit 3. For this reason, if the feed unit 3 is moved downward, the front end of the recording medium cassette 2 is also moved downward so as to follow the feed unit 3.

That is, even though the lower frames 23L and 23R are deformed to the shape shown in FIG. 8B, the feed unit 3 supported by the upper frames 21L and 21R is not displaced relative to the belt unit 5 or the process cartridges 7 and the relative position of the front end of the recording medium cassette 2 relative to the feed unit 3 is not changed in the up-down direction.

Accordingly, the relative positional relationship is not changed on the conveying path that reaches the belt unit 5 or the process cartridges 7 from the recording medium cassette 2 via the feed unit 3. Therefore, the deformation of the lower frames 23L and 23R does not adversely affect the accuracy of the recording medium that is fed by the feed unit 3.

Meanwhile, the convex portion 35A of the protruding piece 35 comes into contact with the convex portion 41A of the guide rail 41 at the rear end of the recording medium cassette 2. For this reason, the rear end of the recording medium cassette 2 is displaced so as to follow the convex portion 41A.

Here, the contact portion between the convex portion 35A and the convex portion 41A is positioned between the rear side of the position P4 of the load transmission portion 54, which is positioned on the rear side, and the position of the leg portion 52, which is positioned on the rear side, in the front-rear direction.

If the lower frames 23L and 23R are distorted and deformed downward due to a load applied from the load transmission portion 54, the upper frames 21L and 21R are displaced downward so as to follow the lower frames 23L and 23R at the position P4 of the load transmission portion 54. For this reason, the relative positional relationship between the upper frames 21L and 21R and the lower frames 23L and 23R does not easily undergo significant change at the position P4.

Further, even if the lower frames 23L and 23R are distorted and deformed downward due to a load applied from the load transmission portion 54, at least the lower frames 23L and 23R are not moved upward toward the upper frames 21L and 21R at the position P2 of the leg portion 52.

That is, if the front end portions, which are positioned on the front side of the position P2 of the leg portion 52, of the lower frames are moved downward, the lower frames 23L and 23R are apt to be rotated about the leg portion 52 toward the upper frames 21L and 21R on the rear side of the position P2 of the leg portion 52.

For this reason, if the recording medium cassette 2 is supported on the rear side of the position P2, the rear end of the recording medium cassette 2 is moved upward. In the case of this embodiment, this causes a problem that the rear end of the recording medium cassette 2 comes into contact with the low-voltage power supply unit 13, and causes the attachment and detachment of the recording medium cassette 2 to be adversely affected. In this regard, if the recording medium cassette 2 is supported at the position P2 of the leg portion 52, the recording medium cassette 2 is not moved upward.

Accordingly, if the contact portion between the convex portion 35A and the convex portion 41A is positioned within the range between the above-mentioned positions P4 and P2, an advantage of suppressing the significant change in the relative positional relationship between the upper frames 21L and 21R and the lower frames 23L and 23R is improved as compared to when the contact portion is positioned outside this range.

Further, as already described above, the plurality of convex portions 41A is formed on the upper surface of the guide rail 41 in order to reduce the friction between the protruding piece 35 and the guide rail 41. In FIGS. 8A and 8B, the right guide rail 41 has been exemplified and five convex portions 41A have been formed on the guide rail 41 for the convenience of showing the convex portions. However, the number of convex portions 41A is arbitrary.

However, regardless of the number of convex portions 41A that are formed, the foremost convex portion 41A of the plurality of convex portions 41A is positioned on the rear side of the position P3 of the load transmission portion 53 that is positioned on the rear side.

The reason for this is as follows: if a convex portion 41A is formed on the front side of the position P3 of the load transmission portion 53 (for example, near the position P4), a problem that the front end of the recording medium cassette 2 comes into contact with the convex portion 41A when being moved downward is easily caused. This also causes the attachment and detachment of the recording medium cassette 2 to be adversely affected.

[Advantage]

As described above, according to the image forming apparatus 1, the feed unit 3 (which corresponds to an example of feed unit in the invention) is supported by the upper frames 21L and 21R. Accordingly, even though the lower frames 23L and 23R are distorted, a relative position of the feed unit relative to the belt unit 5 or the process cartridge 7 (which correspond to an example of image forming unit in the invention) is not changed.

Further, the positioning boss 37 (which corresponds to an example of a "contact portion that is positioned near a first end" in the invention), which is positioned near a front end (which corresponds to an example of a first end in the invention) of the recording medium cassette that is close to the feed unit 3, comes into contact with the positioning groove 45 (which corresponds to an example of a "portion of which a position relative to the upper frame in the up-down direction is not changed" in the invention), so that the recording medium cassette 2 is positioned in the up-down direction. Accordingly, even though the lower frames 23L and 23R are distorted, both the feed unit 3 and the front end of the recording medium cassette 2 are displaced so as to follow the upper frames 21L and 21R, so that the relative position of the feed unit 3 relative to the front end of the recording medium cassette 2 is also not significantly changed.

In addition, the rear end (which corresponds to an example of a second end in the invention) of the recording medium cassette 2, which is disposed at a position apart from the feed unit 3, is displaced somewhat so as to follow the deformation of the lower frames 23L and 23R. However, since this displacement occurs at a position apart from the front end of the recording medium cassette 2, this displacement does not cause the relative position of the feed unit 3 relative to the front end of the recording medium cassette 2 to be significantly changed.

Accordingly, even though the lower frames 23L and 23R are distorted, it may be possible to prevent or suppress the generation of large change on the conveying path that reaches the process cartridges 7 from the recording medium cassette 2 via the feed unit 3 so that the accuracy of the recording medium that is fed by the feed unit 3 is not adversely affected.

Further, according to the image forming apparatus 1, at the rear end of the recording medium cassette 2, the lower frames 23L and 23R and the recording medium cassette 2 are positioned in the up-down direction at a portion where the convex portions 35A and 41A are formed. For this reason, as compared to when the lower frames 23L and 23R and the recording medium cassette 2 come into contact with each other in an area wider than the convex portions 35A and 41A, it is easy to predict how the relative positional relationship between the rear end of the recording medium cassette 2 and the upper frames 21L and 21R will be changed when the lower frames 23L and 23R are distorted. Accordingly, it may be possible to easily optimize a clearance between the rear end of the recording medium cassette 2 and the structure (for example, the low-voltage power supply unit 13) of the upper frames 21L and 21R, on the basis of the prediction.

Furthermore, according to the image forming apparatus 1, gaps are formed between the recording medium cassette 2 and the guide rails 41 of the lower frames 23L and 23R on both sides of the convex portion 41A in the front-rear direction. For this reason, as compared to when the gaps are not formed and the lower frames 23L and 23R and the recording medium cassette 2 come into contact with each other in a wider area, it may be possible to reduce friction between the recording medium cassette 2 and the lower frames 23L and 23R and to easily perform the attachment or detachment of the recording medium cassette 2.

In addition, in the image forming apparatus 1, the convex portions 35A and 41A are formed within the range between the position P4 shown in FIGS. 8A and 8B (which corresponds to an example of a first position in the invention) and the position P2 (which corresponds to an example of a second position in the invention). Accordingly, it may be possible to suppress the significant change in the relative positional relationship between the upper frames 21L and 21R and the rear end of the recording medium cassette 2 supported by the lower frames 23L and 23R at a portion, where the convex portions 35A and 41A are formed, when the lower frames 23L and 23R are distorted and deformed downward due to loads applied from the load transmission portions 53 and 54.

[Modifications]

The embodiment of the invention has been described below. However, the invention is not limited to the above-mentioned specific embodiment and may be modified in various ways.

The feed unit 3 has been provided on the upper side of the front end of the recording medium cassette 2 in the above-mentioned embodiment. However, even when feed unit corresponding to the feed unit 3 is provided on, for example, the upper side of the rear end of the recording medium cassette 2, the invention may also be employed.

That is, an image forming apparatus, which includes the recording medium cassette to be drawn toward the front side and feed unit provided on the upper side of the rear end of the recording medium cassette, may have the following structure. That is, when the recording medium cassette is pushed toward the rear side and attached between lower frames, the rear end of the recording medium cassette comes into contact with a portion of which a relative position relative to the upper frame in the up-down direction is not changed, so that the recording medium cassette may be positioned in the up-down direction. Further, the front end of the recording medium cassette comes into contact with a portion of which a relative position relative to the lower frame in the up-down direction is not changed, so that the recording medium cassette is positioned in the up-down direction. In other words, any one of the first and second ends of the recording medium cassette in the invention may be positioned at the front end of the image forming apparatus.

Moreover, in the above-mentioned embodiment, as a more preferable embodiment, there has been employed the structure where protruding pieces 35 are formed at the recording medium cassette 2, guide rails 41 are formed at the lower frames 23L and 23R, and the recording medium cassette 2 is guided by the protruding pieces and the guide rails. However, in the above-mentioned embodiment, the inclusion of the guide mechanism is optional.

Further, in the above-mentioned embodiment, as a more preferable embodiment, there has been described a case where the convex portions 35A and 41A are provided. However, in the above-mentioned embodiment, the inclusion of the convex portions 35A and 41A is optional.

According to a first aspect of the exemplary embodiment, there is provided an image forming apparatus comprising: a recording medium cassette that stores a recording medium; an image forming unit that forms images on the recording medium; a feed unit that feeds the recording medium stored in the recording medium cassette to the image forming unit; a pair of upper frames that is disposed with a distance between the upper frames in a left-right direction, and supports the image forming unit and the feed unit, which are disposed between the upper frames, from both left and right sides; and a pair of lower frames that is disposed with a distance between the lower frames in the left-right direction, the recording medium cassette being detachably attached in a space formed between the lower frames, the upper frame being disposed on the lower frames, respectively, and the lower frames having rigidity lower than the rigidity of the upper frames, wherein assuming that one end of both ends of the recording medium cassette in a front-rear direction, which is disposed close to the feed unit when the recording medium cassette is attached between the pair of lower frames, is referred to as a first end and the other end thereof, which is disposed distant from the feed unit when the recording medium cassette is attached between the pair of lower frames, is referred to as a second end, when the recording medium cassette is attached between the pair of lower frames, a first contact portion, which is positioned at the first end, comes into contact with a portion, of which a relative position relative to the upper frame in the up-down direction is not changed, at the first end, so that the recording medium cassette is positioned in the up-down direction, and a second contact portion, which is positioned at the second end, comes into contact with a portion, of which a relative position relative to the lower frame in the up-down direction is not changed, at the second end, so that the recording medium cassette is positioned in the up-down direction.

According to the first aspect, the feed unit is supported by the upper frames. Therefore, even though a relative positional relationship between the upper and lower frames is changed due to the distortion of the lower frame of which the rigidity is lower than the rigidity of the upper frame, the relative position between the feed unit and the image forming unit assembled with the upper frame is not changed.

Further, a first contact portion, which is positioned at the first end close to the feed unit, comes into contact with a portion, of which a relative position relative to the upper frame in the up-down direction is not changed, so that the recording medium cassette is positioned in the up-down direction. For this reason, even though a relative positional relationship between the upper and lower frames is changed due to the distortion of the lower frame of which the rigidity is lower than the rigidity of the upper frame, a relative position between the feed unit and the first end of the recording medium cassette is not significantly changed since both the feed unit and the first end of the recording medium cassette are displaced so as to follow the upper frame.

Furthermore, the second end of the recording medium cassette, which is disposed at a position apart from the feed unit, is displaced somewhat so as to follow the deformation of the lower frames. However, since this displacement occurs at a position apart from the first end, this displacement does not cause the relative position between the feed unit and the front end of the recording medium cassette to be significantly changed.

Accordingly, even though the lower frames are distorted, it may be possible to prevent or suppress the generation of large change on the conveying path that reaches the image forming unit from the recording medium cassette via the feed unit so that the accuracy of the recording medium that is fed by the feed unit is not adversely affected.

According to the second aspect of the exemplary embodiment, the upper frame is formed of a metal component and the lower frame is formed of a resin component, so that the rigidity of the lower frame is lower than the rigidity of the upper frame.

According to the second aspect, in addition to the first aspect, the rigidity of the lower frame is made lower than that of the upper frame by changing the materials of the upper and lower frames. Accordingly, even without designing the shape of each portion of the lower frame so that the rigidity of the lower frame becomes low, it may be possible to relatively easily make the rigidity of the lower frames deteriorate.

Meanwhile, other than the second aspect, there may be employed the structure where the shape of each portion of the lower frame is designed so that the rigidity of the lower frame becomes low. Accordingly, if this structure is employed, the upper and lower frames may be made of the same material.

According to the third aspect of the present invention, in addition to the first or second aspect, one or both of "a convex portion which protrudes downward from a part of the recording medium cassette at the second end of the recording medium cassette and of which ends in a protruding direction come into contact with a part of the lower frames" and "a convex portion which protrudes upward from a part of the lower frames and of which ends in a protruding direction come into contact with a part of the recording medium cassette at the second end of the recording medium cassette", wherein a gap is formed between the recording medium cassette and the lower frames on both sides of the convex portion in the front-rear direction, so that the recording medium cassette is positioned in the up-down direction at a portion, where the convex portion is formed, at the second end of the recording medium cassette.

According to the third aspect, the lower frames and the recording medium cassette are positioned in the up-down direction at the portion, where the convex portions are formed, at the second end of the recording medium cassette. For this reason, as compared to when the lower frames and the recording medium cassette come into contact with each other in an area wider than the convex portions, it is easy to predict how the relative positional relationship between the recording medium cassette and the upper frames will be changed when the lower frames are distorted. Accordingly, it may be possible to easily optimize a clearance between the recording medium cassette and the upper frames, on the basis of the prediction.

Further, gaps are formed between the recording medium cassette and the lower frames on both sides of the convex portion in the front-rear direction. Therefore, as compared to when the gaps are not formed and the lower frames and the recording medium cassette come into contact with each other in a wider area, it may be possible to reduce friction between the recording medium cassette and the lower frames and to easily perform the attachment or detachment of the recording medium cassette.

According to the fourth aspect, in addition to the third aspect, a pair of leg portions, which protrudes downward, is formed at the lower ends of the respective lower frames at positions that are apart from each other in the front-rear direction, so that a load is transmitted to the leg portions from the lower frame, a load transmission portion, where a load is transmitted from the upper frames to the lower frames, is formed at the lower end of the respective upper frames at a position that is positioned between the pair of leg portions in the front-rear direction, and assuming that the position of the load transmission portion is referred to as a first position and the position of the leg portion, which is positioned closer to the second end than the load transmission portion, is referred to as a second position, the convex portion is provided within a range between the first and second positions in the front-rear direction.

If the load transmission portion is formed at the first position in the image forming apparatus having the above-mentioned structure and the lower frames are distorted and deformed downward due to a load applied from the load transmission portion, the upper frames are easily displaced downward so as to follow the lower frames at the first position. Therefore, the relative positional relationship between the upper and lower frames is hardly significantly changed at the first position.

Further, since the leg portion is formed at the second position, the lower frames are apt to be rotated about the leg portion toward the upper frames at a position, which is closer to the second end than the leg portion, when the lower frames are distorted and deformed downward due to a load applied from the above-mentioned load transmission portion. However, the lower frames are not moved upward toward the upper frames at the second position of the leg portion. For this reason, if the convex portion is formed at the second position, the relative positional relationship between the upper and lower frames is hardly significantly changed as compared to when the convex portion is formed at a position closer to the second end than the second position.

Accordingly, if the convex portions are positioned within the range between the above-mentioned first and second positions, it may be possible to suppress the significant change in the relative positional relationship between the upper frames and the recording medium cassette supported by the lower frames at a portion of the convex portions when the lower frames are distorted and deformed downward due to loads applied from the load transmission portions.

According to the fifth aspect, in addition to the third or fourth aspect, the lower frames includes a rail for guiding the recording medium cassette to a predetermined receiving position when the recording medium cassette is attached between the pair of lower frames, and the convex portion is one or both of "a convex portion which protrudes downward from a part of the recording medium cassette at the second end of the recording medium cassette and of which ends in a protruding direction come into contact with the rail" and "a convex portion which protrudes upward from the rail and of which ends in a protruding direction come into contact with a part of the recording medium cassette at the second end of the recording medium cassette".

According to the image forming apparatus having the above-mentioned structure, the convex portion is formed on the rail or at a portion that comes into contact with the rail. Accordingly, gaps are formed between the recording medium cassette and the rails on both sides of the convex portion in the front-rear direction.

For this reason, even though the positions or shapes of the rails are changed to some extent due to the distortion of the lower frames, the deformation can be absorbed by the gaps. Accordingly, it may be possible to smoothly perform the attachment or detachment of the recording medium cassette as compared to the structure where the recording medium cassette comes into contact with the rail in a wider area.

According to the sixth aspect, there is provided an image forming apparatus comprising: a recording medium cassette that stores recording medium; an image forming unit that forms images on the recording medium; a feed unit that feeds the recording medium stored in the recording medium cassette to the image forming unit; an upper frame that supports the image forming unit and the feed unit; and a lower frame in which the recording medium cassette is detachably attached, the upper frame being disposed on the lower frame, and the lower frame having rigidity lower than the rigidity of the upper frame, the lower frame including a rail for guiding the recording medium cassette to a predetermined receiving position when the recording medium cassette is attached in the lower frame, wherein the feed unit, which is supported by the upper frame, has a groove portion that is formed along a direction parallel to a horizontal direction, the recording medium cassette has a first convex portion which is fitted in the groove portion when the recording medium cassette is attached in the lower frame, the recording medium cassette having a second convex portion which is contact with a portion of the rail of the lower frame.

According to the seventh aspect, in addition to the sixth aspect, a leg portion, which protrudes downward, is formed on the lower frame at a first position so that a load is transmitted to the leg portion from the lower frame, a load transmission portion, where a load is transmitted from the upper frame to the lower frame, is formed on the upper frame at a second position disposed between the leg portion and a center of the lower frame along the direction parallel to the horizontal direction, and the second convex portion is positioned within a range between the first position and the second position in the direction parallel to the horizontal direction.

What is claimed is:

1. An image forming apparatus comprising:

a recording medium cassette that stores a recording medium;

an image forming unit that forms images on the recording medium;

a feed unit that feeds the recording medium stored in the recording medium cassette to the image forming unit;

a pair of upper frames that is disposed with a distance between the upper frames in a left-right direction, and supports the image forming unit and the feed unit, which are disposed between the upper frames, from both left and right sides; and a pair of lower frames that is disposed with a distance between the lower frames in the left-right direction, the recording medium cassette being detachably attached in a space formed between the lower frames, the upper frames being disposed on the lower frames, respectively, and the lower frames having rigidity lower than the rigidity of the upper frames, wherein:

the recording medium cassette is configured to have a first end disposed close to the feed unit in a front-rear direction and a second end disposed distant from the feed unit in the front-rear direction when the recording medium cassette is attached between the pair of lower frames, and when the recording medium cassette is attached between the pair of lower frames, a first contact portion, which is positioned at the first end, comes into contact with a first portion, of which a position relative to the upper frame in the up-down direction is not changed, at the first end, so that the recording medium cassette is positioned in the up-down direction, and a second contact portion, which is positioned at the second end, comes into contact with a second portion, of which a position relative to the lower frame in the up-down direction is not changed, at the second end, so that the recording medium cassette is positioned in the up-down direction.

2. The image forming apparatus according to claim 1, wherein the upper frame is formed of a metal component and the lower frame is formed of a resin component, so that the rigidity of the lower frame is lower than the rigidity of the upper frame.

3. The image forming apparatus according to claim 1, further comprising one or both of:

a convex portion which protrudes downward from a part of the recording medium cassette at the second end of the recording medium cassette and of which ends in a protruding direction come into contact with a part of the lower frames; and a convex portion which protrudes upward from a part of the lower frames and of which ends in a protruding direction come into contact with a part of the recording medium cassette at the second end of the recording medium cassette, wherein a gap is formed between the recording medium cassette and the lower frames on both sides of the convex portion in the front-rear direction, so that the recording medium cassette is positioned in the up-down direction at a portion, where the convex portion is formed, at the second end of the recording medium cassette.

4. The image forming apparatus according to claim 3, wherein:

a pair of leg portions, which protrudes downward, is formed at the lower ends of the respective lower frames at positions that are apart from each other in the front-rear direction, so that a load is transmitted to the leg portions from the lower frame;

a load transmission portion, where a load is transmitted from the upper frames to the lower frames, is formed at the lower end of the respective upper frames at a position that is positioned between the pair of leg portions in the front-rear direction;

the convex portion is provided within a range between a first position and a second position in the front-rear direction;

the first position is a position of the load transmission portion; and the second position is a position of the leg portion that is closer to the second end than the load transmission portion.

5. The image forming apparatus according to claim 3, wherein:

the lower frames includes a rail for guiding the recording medium cassette to a predetermined receiving position when the recording medium cassette is attached between the pair of lower frames; and the convex portion is one or both of:

a convex portion which protrudes downward from a part of the recording medium cassette at the second end of the recording medium cassette and of which ends in a protruding direction come into contact with the rail, and a convex portion which protrudes upward from the rail and of which ends in a protruding direction come into contact with a part of the recording medium cassette at the second end of the recording medium cassette.

6. An image forming apparatus comprising:

a recording medium cassette that stores recording medium;

an image forming unit that forms images on the recording medium;

a feed unit that feeds the recording medium stored in the recording medium cassette to the image forming unit;

an upper frame that supports the image forming unit and the feed unit; and a lower frame in which the recording medium cassette is detachably attached, the upper frame being disposed on the lower frame, and the lower frame having rigidity lower than the rigidity of the upper frame, the lower frame including a rail for guiding the recording medium cassette to a predetermined receiving position when the recording medium cassette is attached in the lower frame, wherein:

the feed unit, which is supported by the upper frame, has a groove portion that is formed along a direction parallel to a horizontal direction, and the recording medium cassette has a first convex portion which is fitted in the groove portion when the recording medium cassette is attached in the lower frame, the recording medium cassette having a second convex portion which is contact with a portion of the rail of the lower frame.

7. The image forming apparatus according to claim 6, wherein:

a leg portion, which protrudes downward, is formed on the lower frame at a first position so that a load is transmitted to the leg portion from the lower frame;

a load transmission portion, where a load is transmitted from the upper frame to the lower frame, is formed on the upper frame at a second position disposed between the leg portion and a center of the lower frame along the direction parallel to the horizontal direction; and the second convex portion is positioned within a range between the first position and the second position in the direction parallel to the horizontal direction.

* * * * *